US005556318A

United States Patent [19]

So

[11] Patent Number: 5,556,318

[45] Date of Patent: Sep. 17, 1996

[54] TOY CARROUSEL

[75] Inventor: Moon-Lam So, Kowloon, Hong Kong

[73] Assignee: May Cheong Toy Products Factory Limited, Hong Kong, Hong Kong

[21] Appl. No.: 420,207

[22] Filed: Apr. 11, 1995

[51] Int. Cl.[6] ..... A63H 13/20

[52] U.S. Cl. ..... 446/236; 446/238; 446/352; 446/357; 446/358; 40/414; 40/415

[58] Field of Search ..... 446/236, 238, 446/242, 265, 330, 352, 357, 358; 40/411, 414, 415; 472/28, 29, 43

[56] References Cited

U.S. PATENT DOCUMENTS

| | | | |
|---|---|---|---|
| 631,306 | 8/1899 | Hollingsworth | 40/415 |
| 1,098,761 | 6/1914 | Rehlin | 446/242 |
| 1,439,641 | 12/1922 | Rommer | 40/415 |
| 1,566,479 | 12/1925 | Horvath | 40/411 |
| 1,611,155 | 12/1926 | Bisaillon | 40/415 |
| 2,874,513 | 2/1959 | Connell | 40/415 |
| 2,958,144 | 11/1960 | Stranges | 446/236 |
| 3,897,054 | 7/1975 | Riggs | 40/415 |
| 4,344,243 | 8/1982 | Reszka | 40/414 |
| 4,753,436 | 6/1988 | Sinclair | 446/238 |
| 5,226,845 | 7/1993 | Wu | 40/414 |

*Primary Examiner*—Robert A. Hafer
*Assistant Examiner*—Jeffrey D. Carlson
*Attorney, Agent, or Firm*—Samuels, Gauthier, Stevens & Reppert

[57] ABSTRACT

A toy carrousel comprising a body which is formed by a stationary base part and a top part supported above the base part for rotation about a vertical axis. The base part includes a vertical shaft having an upper end reaching into the top part. The top part supports at least one decorative figure atop. The toy carrousel includes a drive mechanism provided in the base part for rotating the top part, which is formed by a motor and a train of gears to be driven by the motor to rotate the top part. The toy carrousel further includes a drive transmission mechanism provided at the upper end of the shaft for setting the decorative figure into individual motion relative to the top part upon rotation of the top part.

10 Claims, 4 Drawing Sheets

TOY CARROUSEL

The present invention relates to a toy carrousel.

SUMMARY OF THE INVENTION

According to a first aspect of the invention, there is provided a toy carrousel which comprises a body which is formed by a stationary base part and a top part supported above the base part for rotation about a vertical axis, said base part including a vertical member having an upper end reaching into the top part and said top part supporting at least one decorative figure atop, a drive mechanism provided in the base part for rotating the top part, said drive mechanism being formed by a motor and a train of gears to be driven by the motor to rotate the top part, and a drive transmission mechanism provided at the upper end of the vertical member for setting the decorative figure into individual motion relative to the top part upon rotation of the top part.

Preferably, the top part is fixed on a bottom platform which is supported on the base part by bearing rollers and in drive engagement with the train of gears.

More preferably, a plurality of vertical posts are provided extending between the top part and the platform, each of said posts supporting a decorative figure and having a lowermost end, and a track provided inside the base part along which the lowermost ends are to move upon rotation of the top part, whereby the posts are set into up-and-down motion relative to the top part and platform.

Advantageously, a roller is provided at the lowermost end of each post for rolling along the track inside the base part.

It is preferred that the upper end of the vertical member is in engagement with the top part, said engagement permitting relative angular movement between the vertical member and the top part.

In a preferred embodiment, the drive transmission mechanism is provided by a toothed member supported on the upper end of the vertical member and by a gear associated with the decorative figure, which gear is arranged to be in engagement with the toothed member so as to be rotated thereby upon rotation of the top part in order to set the decorative figure into individual motion.

Preferably, the gear is provided on a shaft which extends inside the decorative figure for setting the decorative figure into individual motion.

More preferably, an eccentric member is provided on the shaft for setting the decorative figure into individual motion.

In a specific arrangement, the decorative figure is supported by a carrier which is slidable on the top part in a substantially radial direction, thereby causing engagement and disengagement between the gear and the toothed member.

Preferably, the toothed member has an endless track with which the carrier is engaged for sliding by the track upon rotation of the top part.

More preferably, the endless track has a non-circular shape.

According to a second aspect of the invention, there is provided a toy carrousel which comprises a body which is formed by a stationary base part and a top part supported above the base part for rotation about a vertical axis said base part including a vertical member having an upper end reaching into the top part and said top part carrying at least one decorative figure atop, a drive mechanism provided in the base part for rotating the top part, said drive mechanism being formed by a motor and a train of gears to be driven by the motor to rotate the top part, and a drive transmission mechanism provided at the upper end of the vertical member for converting the relative rotation of the top part into individual motion of the decorative figure relative to the top part.

BRIEF DESCRIPTION OF DRAWINGS

The invention will now be more particularly described, by way of example only, with reference to the accompanying drawings, in which.

DETAILED DESCRIPTION OF PREFERRED EMBODIMENT(S)

Figure 1:
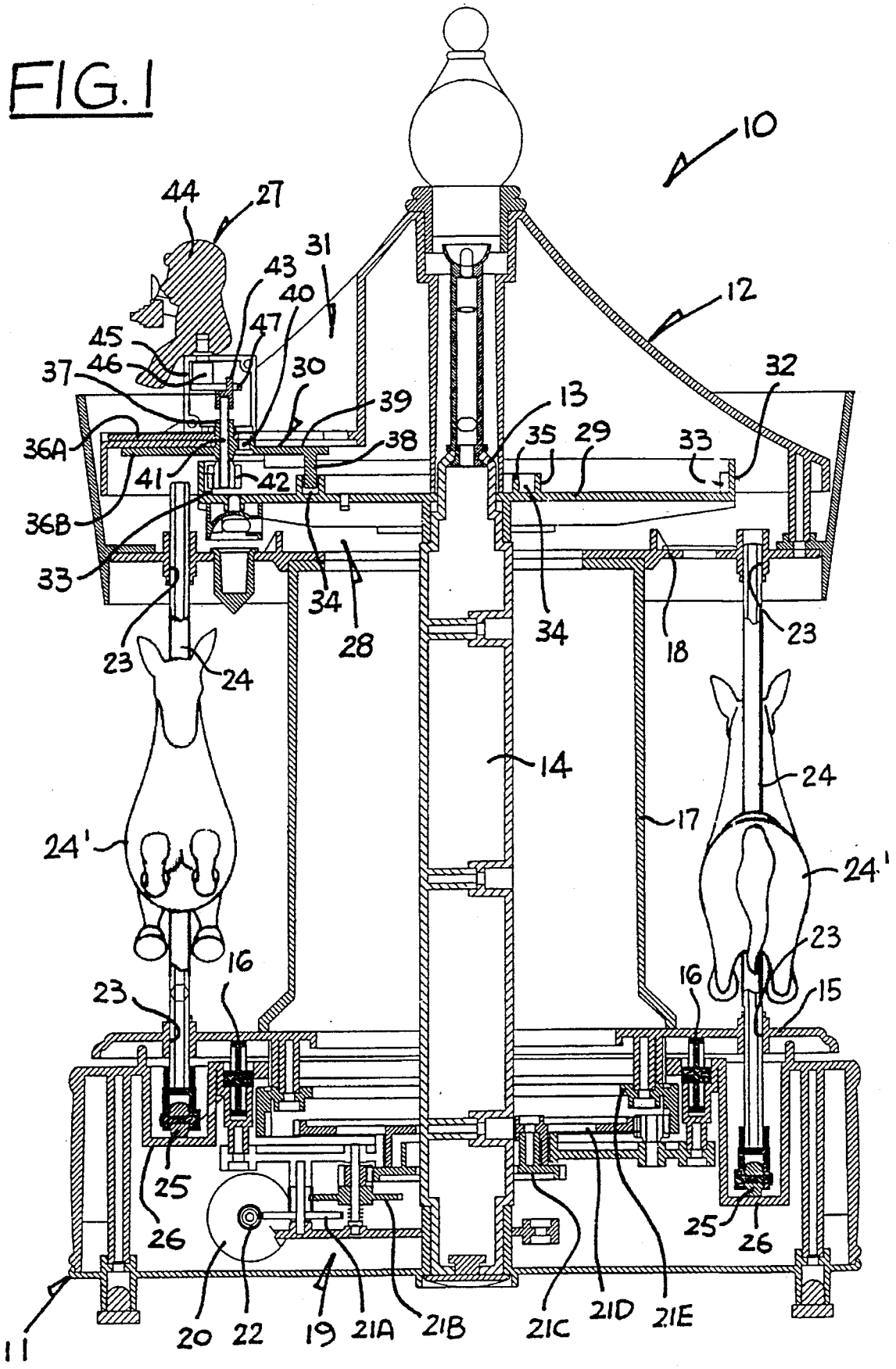
FIG. 1 is a cross-sectional side view of an embodiment of a toy carrousel in accordance with the invention, showing, inter alia, a decorative figure atop and a disc and a carrier for moving individually the decorative figure.

Referring firstly to FIG. 1 of the drawings, there is shown a toy carrousel 10 embodying the invention, which toy carrousel 10 has a body formed by a short cylindrical base 11 and a generally conical roof 12. The base 11 has a central shaft 14 extending vertically upwards into the roof 12. The roof 12 engages co-axially with an upper end 13 of the shaft 14 for relative rotation about the shaft 14. A circular platform 15 is supported by four bearing rollers 16 horizontally on the base 11 for rotation about the shaft 14. The shaft 14 is surrounded co-axially by a hollow prismatic sleeve 17 which is connected at its upper end to a bottom wall 18 of the roof 12 and at its lower end to the platform 15. In this construction, rotation of the platform 15 will cause direct rotation of the sleeve 17 and hence the roof 12.

The toy carrousel 10 includes a drive mechanism 19 provided inside the base 11 for rotating the platform 15 and hence the roof 12. The drive mechanism 19 is provided by a DC electric motor 20 and a train of five gear wheels 21A to 21E for transmitting the motor drive to the platform 15 at a reduced speed. The first gear wheel 21A is in mesh with an output worm-gear 22 of the motor 20, and the last gear wheel 21E is mounted co-axially underneath the platform 15. The drive mechanism 19 is operated on a DC voltage by means of a AC/DC voltage adaptor under the control of a manual electrical switch (not shown).

The bottom wall 18 of the roof 12 and the platform 15 have four pairs of aligned holes 23 for slidably receiving four corresponding equi-angularly spaced vertical posts 24. The bottom ends of the posts 24 are fitted with corresponding rollers 25 for running on and along a generally circular stationary track 28. The track 28 is provided inside the base 11 and lies on an imaginary plane which is inclined at a small angle to the platform 15 such that upon rotation of the platform 15 and roof 12, the posts 24 will not only turn around the axis of rotation but also move up-and-down relative to the platform 15 and roof 12. A horse figure 24' is mounted midway on each post 24, for movement therewith, as in the case of a genuine carrousel found in an amusement park. Four twisted posts (not shown) are fixed vertically between the roof bottom wall 18 and the platform 15, equi-angularly spaced and interlaced with the posts 24, for reinforcing the support of the roof 12 on the platform 15.

Four decorative FIGS. 27, each of a different design, are provided on the roof 12. The toy carrousel 10 further includes a drive transmission mechanism 28 inside the roof 12 for setting the decorative FIGS. 27 into individual motion upon rotation of the roof 12, which mechanism 28 is provided by a horizontal disc 29 and four carriers 30. The roof 12 has four equi-angularly spaced recesses 31, in each of which a corresponding carrier 30 is placed to support a respective decorative FIG. 27. The disc 29 is mounted fast axially on the upper end 13 of the shaft 14, at a position immediately below the four carriers 30. The disc 29 has an upstanding peripheral wall 32 bearing, on the inner side thereof, a ring of gearing teeth 33. A non-circular circular endless cam track 34 is provided on the disc 29, which is formed by a pair of ribs 35 co-extending around the shaft 14.

Each carrier 30 takes the form of an overlapped pair of co-extending upper and lower rectangular plates 36A and 36B. The lower plate 36B has, at its centre, an upstanding integral tube 37 and, at its rear end, a depending integral post 38. Each recess 31 has, at its bottom wall, a slot 39 which extends radially with respect to the shaft 14. The plates 36A and 36B of each carrier 30 are placed against opposite sides of the respective slot 39, extending parallel thereto, with the tube 37 of the lower plate 36B extending upwards through the slot 39 and a hole in the upper plate 36A and with its post 38 slidably engaging downwards within the cam track 34. The carrier plates 36A and 36B are held together by means of a screw 40 through the slot 39, at a position adjacent the tube 37. With said tubular and screwed-together part of the lower plate 36B engaging slidably within the slot 39, the carrier 30 is slidable lengthwise relative to the slot 39.

Figure 4:
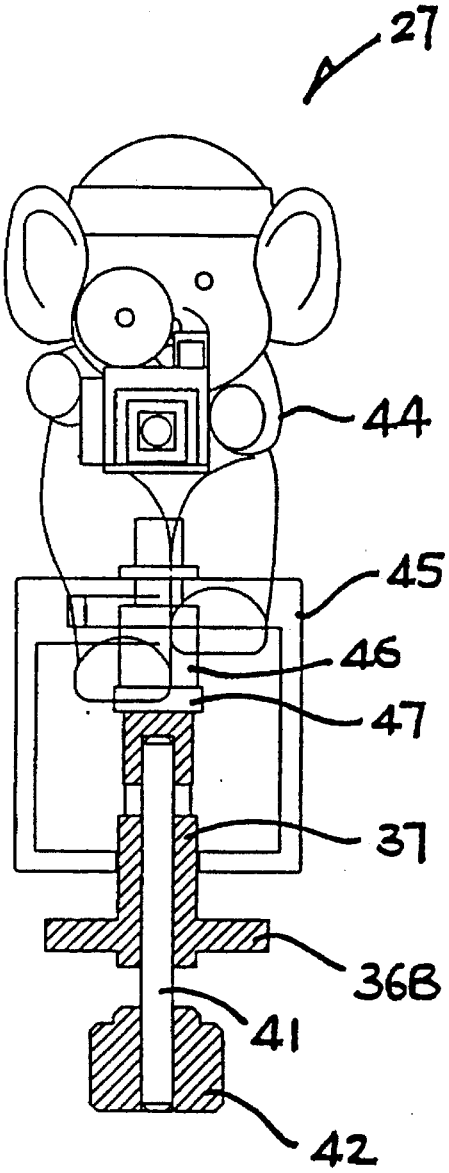
FIG. 4 is a cross-sectional front view of the decorative FIG. 1.
Figure 3:
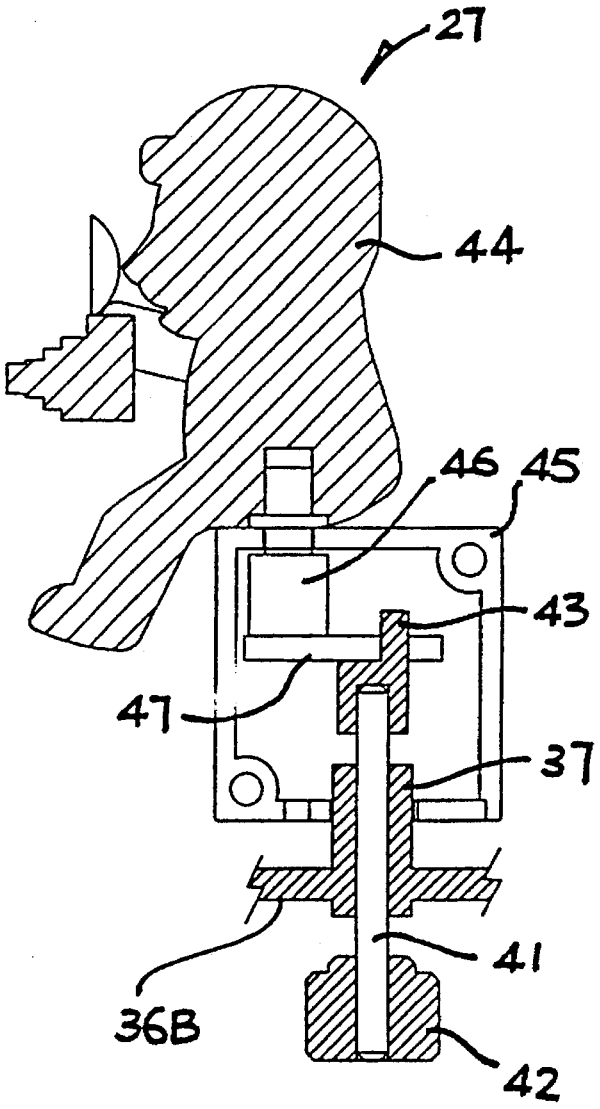
FIG. 3 is a cross-sectional side view of the decorative figure of FIG. 1.

Reference is also made to FIGS. 3 and 4 which show one example of the decorative FIGS. 27. The tube 37 of the associated carrier 30 receives a shaft 41. A pinion 42 is mounted fast on the lower end of the shaft 41, which pinion 42 is positioned at the same level as and in front of the teeth 33 of the disc 29. The upper end of the shaft 41 is fitted with an end piece having an eccentric axial protrusion 43. The decorative FIG. 27 is in the form of a mouse 44 (holding a camera) sitting on a box 45. The mouse 44 is movably connected to the box 45 by means of an L-shaped coupler 46 which has a horizontal lower limb 47 inside the box 45. The box 45 is located on the carrier 30 at a position directly over the tube 37, with the end piece bearing the eccentric protrusion 43 inside the box 45. The protrusion 43 loosely engages with the lower limb 47 of the coupler 46, through a bifurcated end of the limb 47.

Figure 2:
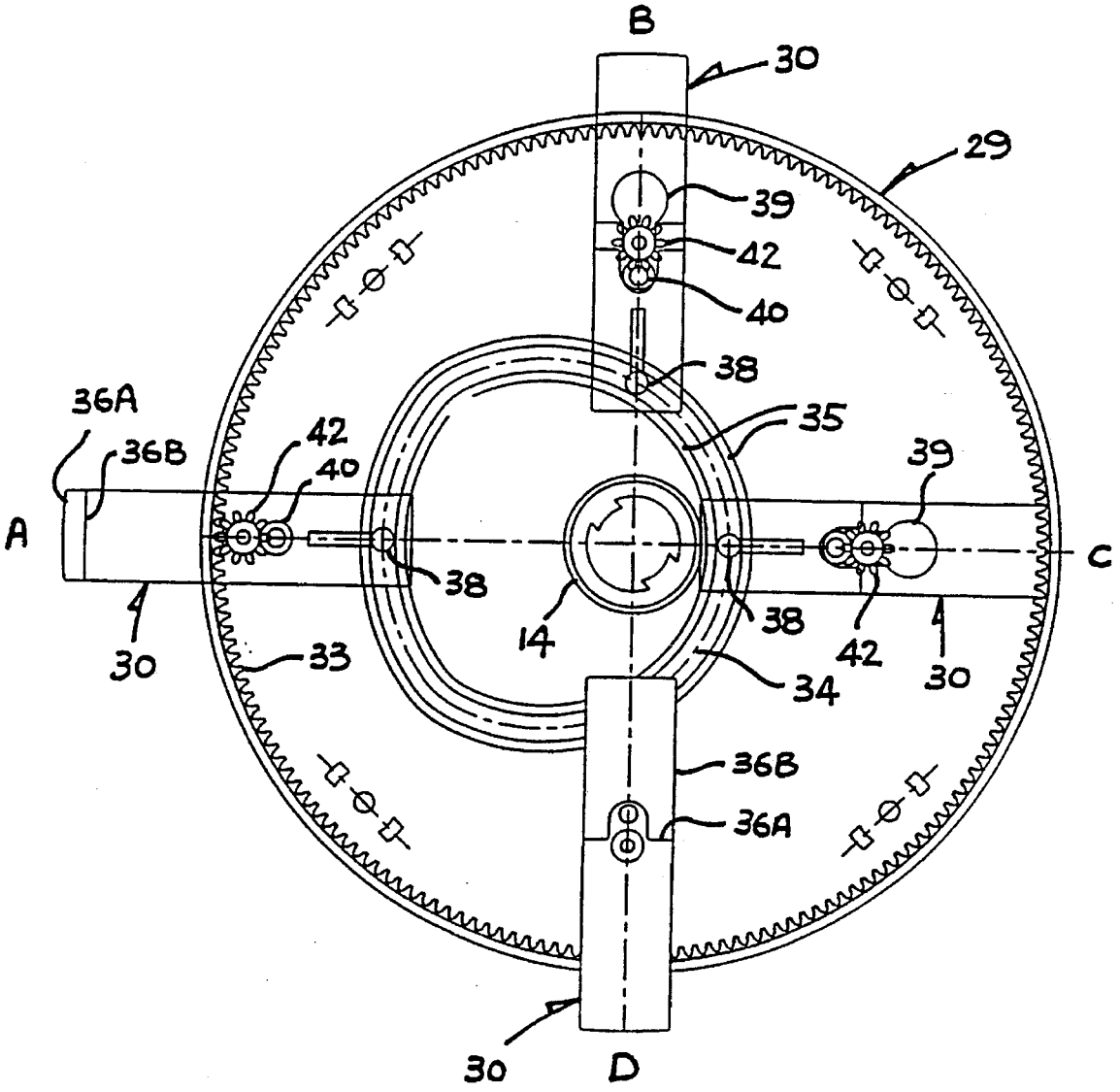
FIG. 2 is a top plan view of the disc and the carrier(s) shown in FIG. 1.

Reference is now also made to FIG. 2. Upon operation of the drive mechanism 19, the platform 15 is turned by the motor 20 by means of the train of gears 21A to 21E. Turning of the platform 15 brings about rotation of the roof 12 relative to the disc 29 which remains stationary through support by the fixed shaft 14. As the roof 12 rotates, the carriers 30 are brought to move angularly at the same time relative to the disc 29, which results in sliding movement of the corresponding posts 38 along the cam track 34. By reason of the cam track 34 being non-circular (or eccentric) with respect to the axis of rotation, the carriers 30 are also subject to sliding back-and-forth radially with respect to the centre of rotation through engagement of their posts 38 with the cam track 34.

In the foremost radial position of the carrier 30 (position A in FIG. 2), the pinion 42 is moved against the stationary teeth 38 and thus rotates therealong. Rotation of the pinion 42 causes the shaft 41 and hence the eccentric protrusion 43 to rotate, thereby setting the coupler 46 into a limited wobbling action. Thus, the mouse 44 wobbles slowly in a lifelike manner. As the carrier 30 moves angularly off position A towards position B, it is being slid radially backwards through the sliding engagement between the post 38 and the cam track 34, whereby the pinion 42 disengages from the teeth 33 and the wobbling motion of the mouse 44 stops. In the next position C of the carrier 30 the mouse-on-box FIG. 27 is slid radially most backwards, and subsequently in position D the mouse-on-box FIG. 27 is on forward radial sliding movement. Shortly before the carrier 30 returns back to position A, the mouse 44 is set into the wobbling motion again, and the cycle repeats. In fact, positions A to D represent the corresponding positions and conditions of the four carriers 30, supporting the respective different decorative FIGS. 27, at this particular instance.

Figure 5:
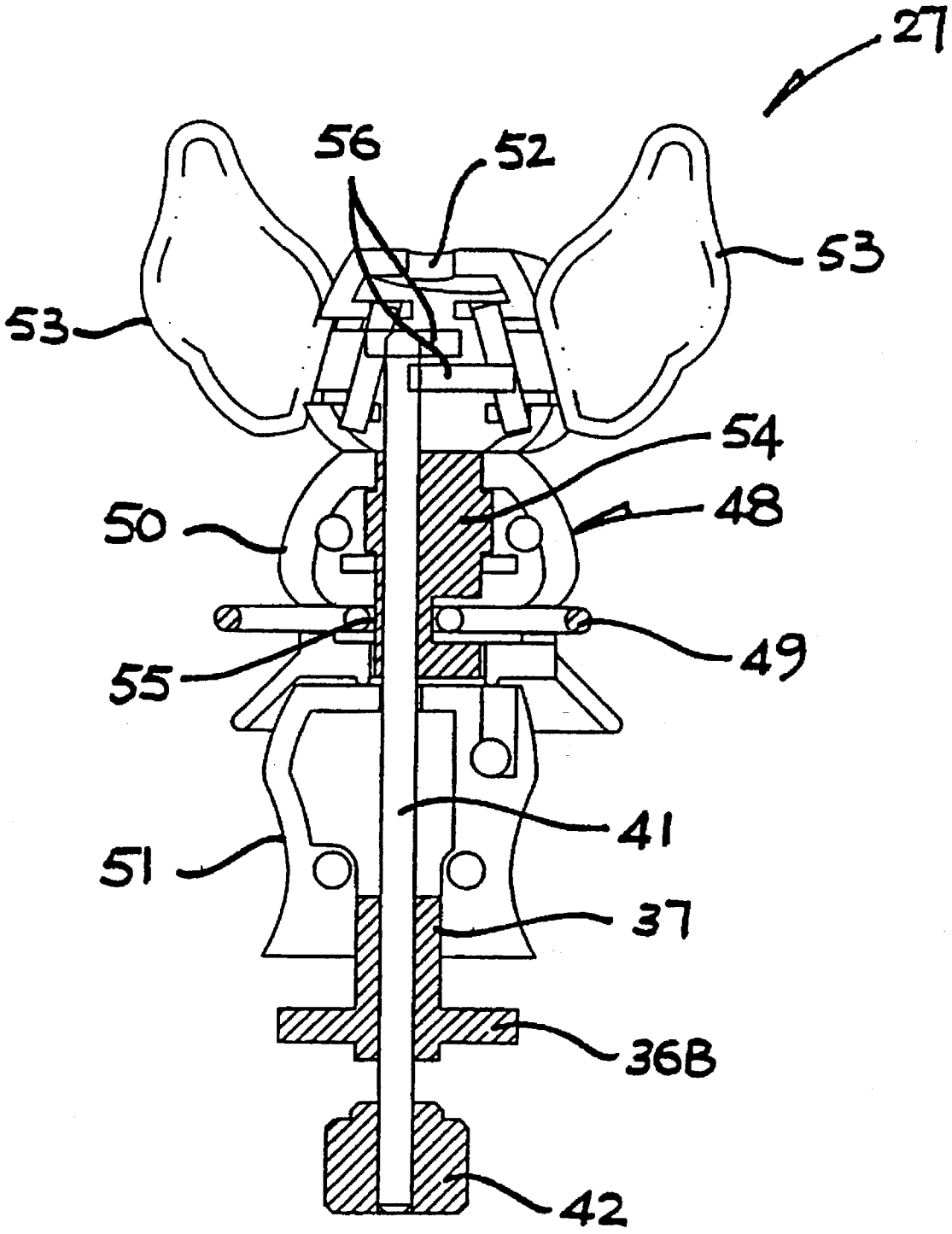
FIG. 5 is a cross-sectional side view of another decorative figure of the toy carrousel of FIG. 1.

FIG. 5 shows another example of the decorative figures 27, which is in the form of a standing elephant 48 playing a hola loop 49. The elephant 48 has an upper body 50, a lower body 51 and a head 52 having a pair of flapping ears 53 on the upper body 50. The carrier 30 supporting the elephant 48 has a shaft 41 which is relatively longer. The shaft 41 extends upwards through the lower and upper bodies 51 and 50 into the head 52. The lower body 51 is fixed coaxially on the tube 37 of the carrier 30. The upper body 50 is supported on the lower body 51 for a slight side-to-side movement thereon. An internal eccentric cam piece 54 is mounted fast on the shaft 41, which co-acts with the interior of the upper body 50. Rotation of the cam piece 54 by the shaft 41 causes the upper body 50 to move slightly side-to-side relative to the lower body 51, thereby simulating a wiggling motion. The hola loop 49 is supported on the waist of the upper body 50, around a circular section 55 of the cam piece 54 concentric with the shaft 41 such that the hola loop 49 will not move sideways with the upper body 50. Uppermost end of the shaft 41 has a pair of side flaps 56 for flapping the two ears 53 upon rotation of the shaft 41.

The carrousel 10 includes a music tune playing function, under the control of an integrated circuit driving a speaker, which is performed whenever the drive mechanism 19 operates.

The invention has been given by way of example only, and various modifications of and/or alterations to the described embodiment(s) may be made by persons skilled in the art without departing from the scope of the invention as specified in the appended claims.

What is claimed is:

1. A toy carrousel comprising a body which is formed by a stationary base part and a top part supported above the base part for rotation about a vertical axis, said base part including a vertical member having an upper end reaching into the top part and said top part supporting at least one decorative figure atop, a first drive mechanism provided in the base part for rotating the top part, said drive mechanism being formed by a motor and a train of gears to be driven by the motor to rotate the top part, and a second drive transmission mechanism provided at the upper end of the vertical member for setting the decorative figure into individual motion relative to the top part upon rotation of the top part; wherein the second drive transmission mechanism is provided by a toothed member supported on the upper end of the vertical member and by a gear associated with the decorative figure, which gear is arranged to be in engagement with the toothed member so as to be rotated thereby upon rotation of the top part in order to set the decorative figure into individual motion.

2. A toy carrousel as claimed in claim 1, wherein the top part is fixed on a bottom platform which is supported on the base part by bearing rollers and in drive engagement with the train of gears.

3. A toy carrousel as claimed in claim 2, wherein a plurality of vertical posts are provided extending between the top part and the platform, each of said posts supporting a decorative figure and having a lowermost end, and an inclined track provided inside the base part along which the lowermost ends are to move upon rotation of the top part, whereby the posts are set into up-and-down motion relative to the top part and platform.

4. A toy carrousel as claimed in claim 3, wherein a roller is provided at the lowermost end of each post for rolling along the track inside the base part.

5. A toy carrousel as claimed in claim 1, wherein the upper end of the vertical member is in engagement with the top part, said engagement permitting relative angular movement between the vertical member and the top part.

6. A toy carrousel as claimed in claim 1, wherein the gear of the second drive transmission is provided on a shaft which extends inside the decorative figure for setting the decorative figure into individual motion.

7. A toy carrousel as claimed in claim 6, wherein an eccentric member is provided on the shaft for setting the decorative figure into individual motion.

8. A toy carrousel as claimed in claim 1, wherein the decorative figure is supported by a carrier which is slidable on the top part in a substantially radial direction, causing engagement and disengagement between the gear and the toothed member of the second drive transmission.

9. Toy carrousel as claimed in claim 8, wherein the toothed member has an endless track with which the carrier is engaged for sliding along the track upon rotation of the top part.

10. A toy carrousel as claimed in claim 9, wherein the endless track has a non-circular shape.

* * * * *